US010699662B2

(12) United States Patent
Liu et al.

(10) Patent No.: US 10,699,662 B2
(45) **Date of Patent: *Jun. 30, 2020**

(54) INTEGRATED CIRCUIT FOR DRIVING DISPLAY PANEL AND METHOD THEREOF

(71) Applicant: Novatek Microelectronics Corp., Hsinchu (TW)

(72) Inventors: I-Te Liu, Chiayi County (TW); Chia-Wei Chang, Taoyuan (TW); Chien-Yu Chen, Hsinchu County (TW); Hsien-Wen Lo, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/614,629

(22) Filed: Jun. 6, 2017

(65) Prior Publication Data

US 2018/0075802 A1 Mar. 15, 2018

Related U.S. Application Data

(60) Provisional application No. 62/393,099, filed on Sep. 12, 2016.

(51) Int. Cl.
*G09G 3/36* (2006.01)
*G09G 3/20* (2006.01)
*G09G 3/3233* (2016.01)

(52) U.S. Cl.
CPC ..... *G09G 3/3696* (2013.01); *G09G 3/20* (2013.01); *G09G 3/3233* (2013.01);
(Continued)

(58) Field of Classification Search
CPC ..... G09G 3/3233; G09G 3/20; G09G 3/3648; G09G 3/3607; G09G 2320/0233;
(Continued)

(56) References Cited

U.S. PATENT DOCUMENTS 8,947,408 B2 2/2015 Lin et al.
9,396,695 B2 7/2016 Lin et al.
(Continued)

FOREIGN PATENT DOCUMENTS

CN 105702218 6/2016
TW 201411585 3/2014

OTHER PUBLICATIONS

"Office Action of China Counterpart Application", dated Oct. 23, 2019, p. 1-10.

*Primary Examiner* — David Tung
(74) *Attorney, Agent, or Firm* — JCIPRNET

(57) ABSTRACT

An integrated circuit for driving a display panel is provided. The integrated circuit includes a gamma mapping unit and a mura compensation unit. The gamma mapping unit is configured to receive a gray level of an image data, map the gray level to a gamma code according to at least one gamma table, and output the gamma code. The mura compensation unit is configured to receive the gamma code, and compensate the gamma code according to at least one de-mura table to generate a compensation result after the gamma mapping unit performs the step of mapping the gray level to the gamma code. The integrated circuit drives the display panel according to the compensation result. In addition, a method for driving a display panel is also provided.

11 Claims, 8 Drawing Sheets

(52) U.S. Cl.
CPC ..... *G09G 3/3648* (2013.01); *G09G 2300/043* (2013.01); *G09G 2310/0264* (2013.01); *G09G 2320/0233* (2013.01); *G09G 2320/0285* (2013.01); *G09G 2320/0673* (2013.01)

(58) Field of Classification Search
CPC ... G09G 2320/0285; G09G 2320/0673; G09G 2300/043; G09G 2310/0264; G09G 2310/027
See application file for complete search history.

(56) References Cited

U.S. PATENT DOCUMENTS

| | | | | |
|---|---|---|---|---|
| 9,881,568 | B2 | 1/2018 | Na et al. | |
| 10,096,290 | B2 | 10/2018 | Na et al. | |
| 2014/0071106 | A1 | 3/2014 | Lin, Jr. et al. | |
| 2014/0184671 | A1 | 7/2014 | Lee | |
| 2014/0253602 | A1* | 9/2014 | Wu | G09G 3/20 345/690 |
| 2015/0084947 | A1* | 3/2015 | Lin et al. | G09G 3/3696 345/212 |
| 2016/0171939 | A1* | 6/2016 | Na | G09G 3/3607 345/690 |
| 2018/0102099 | A1 | 4/2018 | Na et al. | |
| 2018/0233096 | A1* | 8/2018 | Zhao | G09G 3/3688 |

* cited by examiner

INTEGRATED CIRCUIT FOR DRIVING DISPLAY PANEL AND METHOD THEREOF

CROSS-REFERENCE TO RELATED APPLICATION

This application claims the priority benefits of U.S. provisional application Ser. No. 62/393,099, filed on Sep. 12, 2016. The entirety of the above-mentioned patent application is hereby incorporated by reference herein and made a part of this specification.

BACKGROUND OF THE INVENTION

1. Field of the Invention

The invention generally relates to an integrated circuit and a method thereof, in particular, to an integrated circuit for driving a display panel and a method thereof.

2. Description of Related Art

The advanced opto-electronic and semiconductor technology brings about the prosperous development of flat panel displays, curve panel displays or stereoscopic displays. Flat panel displays include displays of several different technologies, among which the liquid crystal display (LCD) has become the mainstream on the market for its characteristics such as high space utilization, low power consumption, absence of radiation, and low electromagnetic interference.

In the framework of liquid crystal displays nowadays, a gamma voltage generating apparatus is required for a source driver of a liquid crystal driver to generate a plurality of gamma voltages according to a gamma table, and control the liquid crystal display panel to display corresponding gray level values accordingly, thereby displaying high-quality images. A setting of the gamma table may change according to different display panels. In addition, a display panel is manufactured through a series of complicated processes. If a small defect appears in one of the processes, quality of the display panel may be adversely affected and visible defects may appear. One such viewing defect is the so-called "mura effect", for example.

Various imperfections in the display components may result in undesirable modulations of the luminance, causing the mura defects. There are many stages in the manufacturing process that may result in Mura defects on the display. "Mura" defects cause one or more pixels to be brighter or darker than surrounding pixels, resulting contrast-type defects. Generically, such contrast-type defects may be identified as "blobs", "bands", "streaks", etc. Mura defects may also be referred to as "Alluk" defects or generally non-uniformity distortions. Mura defects may appear as low frequency, high-frequency, noise-like, and/or very structured patterns on the display.

SUMMARY OF THE INVENTION

Accordingly, the invention is directed to an integrated circuit for driving a display panel and a method thereof, in which the mura effect may be reduced.

An exemplary embodiment of the invention provides an integrated circuit for driving a display panel. The integrated circuit includes a gamma mapping unit and a mura compensation unit. The gamma mapping unit is configured to receive a gray level of an image data, map the gray level to a gamma code according to at least one gamma table, and output the gamma code. The mura compensation unit is configured to receive the gamma code, and compensate the gamma code according to at least one de-mura table to generate a compensation result after the gamma mapping unit performs the step of mapping the gray level to the gamma code. The integrated circuit drives the display panel according to the compensation result.

In an exemplary embodiment of the invention, the at least one de-mura table records mura calibration data for a plurality of panel areas.

In an exemplary embodiment of the invention, the mura calibration data includes a plurality of values of mura calibration data respectively corresponding to a plurality values of gamma code for each of the panel areas.

In an exemplary embodiment of the invention, the mura calibration data represents a plurality of calibration curves respectively corresponding to the plurality of panel areas.

In an exemplary embodiment of the invention, the integrated circuit further includes a voltage generating unit. The voltage generating unit is configured to receive the compensation result including a compensated value of gamma code, and generate a display voltage according to the compensated value of gamma code to drive the display panel.

In an exemplary embodiment of the invention, the at least one gamma table records a plurality of values of gamma code respectively corresponding to a plurality of values of gray level.

In an exemplary embodiment of the invention, the at least one de-mura table is the same when a setting of the at least one gamma table is modified.

An exemplary embodiment of the invention provides an integrated circuit for driving a display panel. The integrated circuit includes a transformation unit d a mura compensation unit. The transformation unit is configured to perform a non-linear transformation on an image data to generate an output code based on a characteristics of the display panel. The mura compensation unit is configured to receive the output code from the transformation unit, and compensate the output code to reduce a mura effect of the display panel and generate a compensation result after the transformation unit performs the non-linear transformation. The integrated circuit drives the display panel according to the compensation result.

In an exemplary embodiment of the invention, the non-linear transformation of the transformation unit includes a gamma mapping.

An exemplary embodiment of the invention provides a method for driving a display panel includes: mapping a gray level of an image data to a gamma code according to at least one gamma table; compensating the gamma code according to at least one de-mura table to generate a compensation result after the step of mapping the gray level to the gamma code; and driving the display panel according to the compensation result.

In an exemplary embodiment of the invention, the at least one de-mura table records mura calibration data for a plurality of panel areas.

In an exemplary embodiment of the invention, the mura calibration data includes a plurality of values of mura calibration data respectively corresponding to a plurality values of gamma code for each of the panel areas.

In an exemplary embodiment of the invention, the mura calibration data represents a plurality of calibration curves respectively corresponding to the plurality of panel areas.

In an exemplary embodiment of the invention, the compensation result includes a compensated value of gamma code. The method further includes generating a display voltage according to the compensated value of gamma code to drive the display panel.

In an exemplary embodiment of the invention, the at least one gamma table records a plurality of values of gamma code respectively corresponding to a plurality of values of gray level.

In an exemplary embodiment of the invention, the at least one de-mura table is the same when a setting of the at least one gamma table is modified.

An exemplary embodiment of the invention provides a method for driving a display panel includes: performing a non-linear transformation on an image data to generate an output code based on a characteristics of the display panel; compensating the output code to reduce a mura effect of the display panel and generating a compensation result after the non-linear transformation; and driving the display panel according to the compensation result.

In an exemplary embodiment of the invention, the non-linear transformation includes a gamma mapping.

In an exemplary embodiment of the invention, compensation data used in the compensating is the same when a setting of the non-linear transformation is modified.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
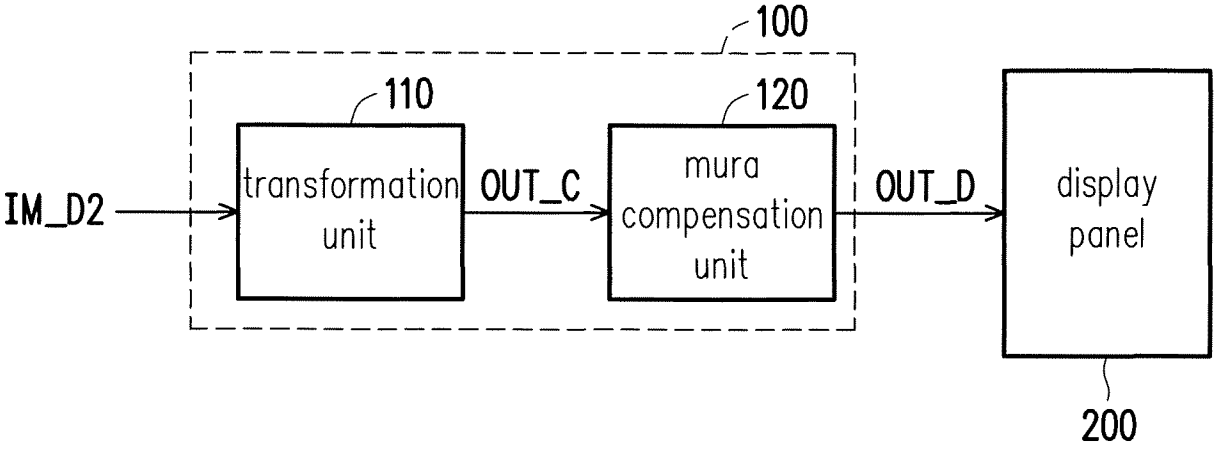
FIG. 1 illustrates a schematic diagram of an integrated circuit for driving a display panel according to an exemplary embodiment.

Reference will now be made in detail to the present preferred embodiments of the invention, examples of which are illustrated in the accompanying drawings. Wherever possible, the same reference numbers are used in the drawings and the description to refer to the same or like parts.

The term "coupling/coupled" used in this specification (including claims) of the disclosure may refer to any direct or indirect connection means. For example, "a first device is coupled to a second device" should be interpreted as "the first device is directly connected to the second device" or "the first device is indirectly connected to the second device through other devices or connection means." In addition, the term "signal" can refer to a current, a voltage, a charge, a temperature, data, electromagnetic wave or any one or multiple signals.

Figure 2:
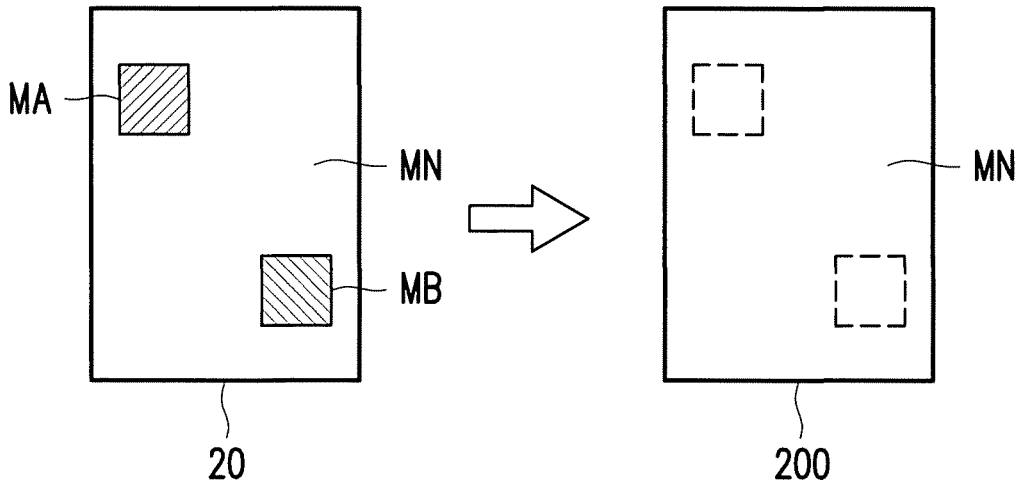
FIG. 2 illustrates the display panel depicted in FIG. 1 before mura compensation and after mura compensation.

FIG. 1 illustrates a schematic diagram of an integrated circuit for driving a display panel according to an exemplary embodiment. FIG. 2 illustrates a display panel such as the display panel depicted in FIG. 1 (but not limited thereto) before mura compensation and after mura compensation.

Referring to FIG. 1 and FIG. 2, an integrated circuit 100 of the present embodiment includes a transformation unit 110 and a mura compensation unit 120. The transformation unit 110 is configured to perform a non-linear transformation on an image data IM_D2 to generate an output code OUT_C based on one or more characteristics of a display panel 200 such as process, material, gamma parameter, brightness or color temperature. The mura compensation unit 120 is configured to receive the output code OUT_C from the transformation unit 110, and compensate the output code OUT_C to reduce a mura effect of the display panel 200 and generate a compensation result OUT_D after the transformation unit 110 performs the non-linear transformation. The integrated circuit 100 drives the display panel 200 according to the compensation result OUT_D.

In an embodiment, the non-linear transformation of the transformation unit 110 may include a gamma mapping. The gamma mapping is a non-linear operation used to encode and decode the image data IM_D2. For example, the transformation unit 110 may map a gray level of the image data IM_D2 to a gamma code according to at least one gamma table, and output the gamma code. The gamma table may be stored in the integrated circuit 100 for the non-linear transformation.

As shown in FIG. 2, the display panel 20 includes a plurality of panel areas such as MA and MB having mura phenomenon before mura compensation. In the present embodiment, the mura compensation unit 120 compensates the output code OUT_C and generates the compensation result OUT_D. The integrated circuit 100 drives the display panel 200 according to the compensation result OUT_D. The mura effect of the display panel 200 can be reduced, and thus the display panel 200 can provide good display quality. It is noted each of the panel areas receiving mura compensation can include one or more pixels or sub-pixels.

In the present embodiment, the block units of the integrated circuit 100 may be implemented by using adaptive circuit structures in the related art, which are not particularly limited in the invention. In the present embodiment, the display panel 200 includes a flat panel, a curved panel or a 3D display, including Liquid Crystal Display (LCD), Plasma Display Panel (PDP), Organic Light Emitting Display (OLED), Field Emission Display (FED), Electro-Phoretic Display (EPD) or Light Emitting Diode Display and the like, which are not limited in the invention. Moreover, the display panel may be integrated with other function (such as a touch function to form such as a touch display panel).

Figure 3:
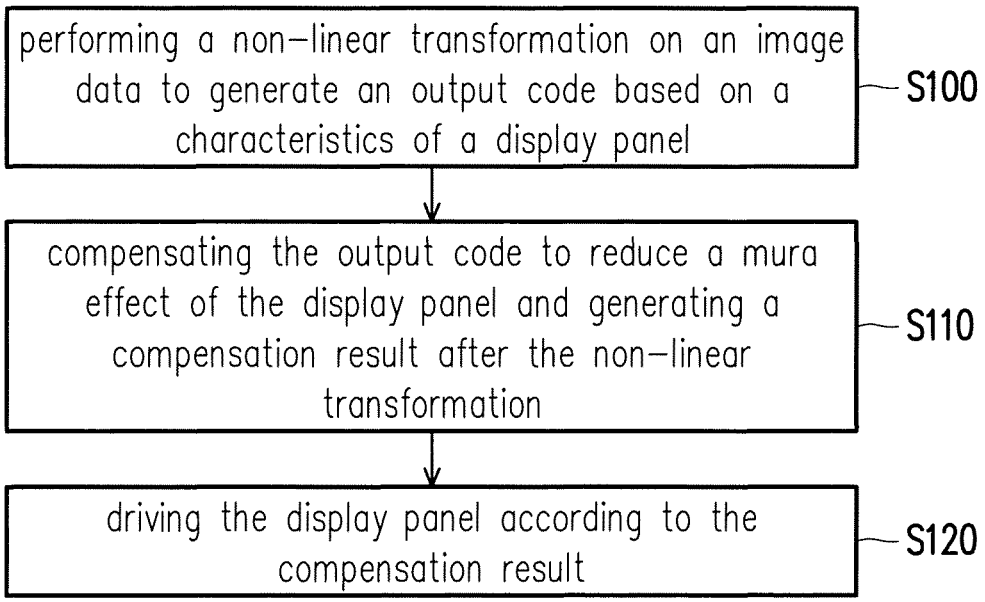
FIG. 3 is a flowchart illustrating steps in a method for driving a display panel according to an exemplary embodiment.

FIG. 3 is a flowchart illustrating steps in a method for driving a display panel according to an exemplary embodiment. Referring to FIG. 1 and FIG. 3, the method of the present embodiment can at least be adapted to the integrated circuit 100 of FIG. 1, but the invention is not limited thereto.

Taking the integrated circuit 100 for example, in step S100, the transformation unit 110 performs a non-linear transformation on an image data IM_D2 to generate an output code OUTS based on a characteristics of the display panel 200. The non-linear transformation can transform linear image data (or gray level) to a nonlinear output of source voltage or data voltage. The transformation may be performed based on curves representing relationships between luminance on the display panel 200 and source voltage (or gamma code). In some implementations, the nonlinear transformation can be gamma mapping but not limited thereto. With such a non-linear transformation, the luminance on the display panel 200 can demonstrate a non-linear relationship (e.g., 2.2) so as to match viewing characteristics of human eyes. The transformation can be set differently according to characteristics of display panel, γ value, luminance, and color temperatures.

In step S110, the mura compensation unit 120 compensates the output code OUT_C to reduce a mura effect of the display panel 200 and generates a compensation result OUT_D after the non-linear transformation. The mure compensation can compensate for non-uniformity with respect to a measured relationship between luminance and gray level for pixels or sub-pixels on the display panel 200. After display panels are manufactured, curves representing relationship between luminance and gray level for pixels or sub-pixels on the display panels can be measured such as by cameras. Mura effect causes the curves for different pixels/sub pixels to differ from each other. The compensation for each gray level can therefore be performed based on the difference between the curves. As a result, data for compensating the source voltages (compensation data) can be generated by using the curve difference. The compensation data can be stored in a memory such as a SRAM.

In step S120, the integrated circuit 100 drives the display panel 200 according to the compensation result OUT_D. The compensation result OUT_D can produce uniform display since the source voltage or the output code OUT_C have been compensated to reduce or eliminate the luminance difference between pixels/sub-pixels.

It is noted that the mura compensation can be based on differences between the curves representing the relationship between the luminance of sub-pixels/pixels and source voltages. In this way, even when the setting for the nonlinear transformation or gamma mapping is modified, the same setting or data for mura compensation can be used, because the curves representing the relationship between the luminance of sub-pixels/pixels and source voltages depend only upon characteristics of the display panel instead of the setting for the gamma mapping or nonlinear transformation. Consequently, the configuration of the embodiment can be implemented with a fixed amount of space for storing the mura compensation data, without being affected by adjustment of the gamma mapping or nonlinear transformation.

In addition, sufficient teaching, suggestion, and implementation illustration regarding the method for driving the display panel of the exemplary embodiment may be obtained from the foregoing embodiments of FIG. 1 to FIG. 2, and thus related description thereof is not repeated hereinafter.

Figure 4:
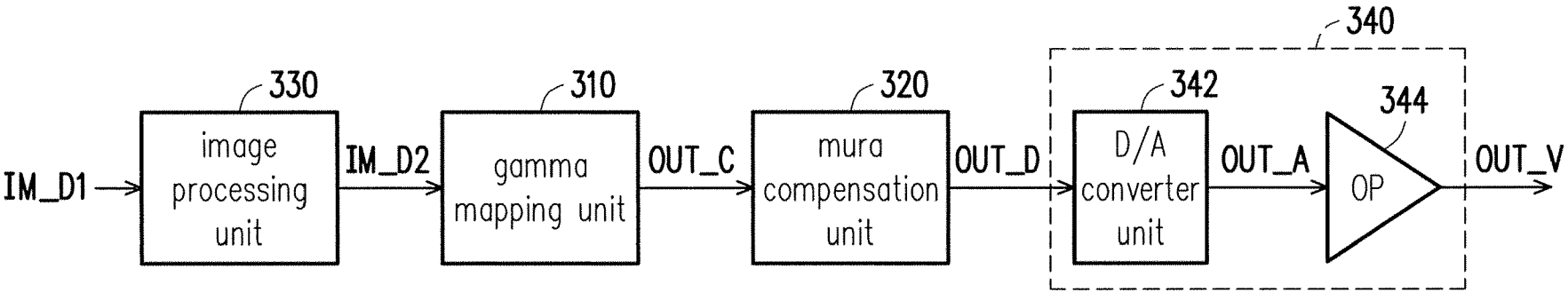
FIG. 4 illustrates a schematic diagram of an integrated circuit for driving a display panel according to another exemplary embodiment.
Figure 5:
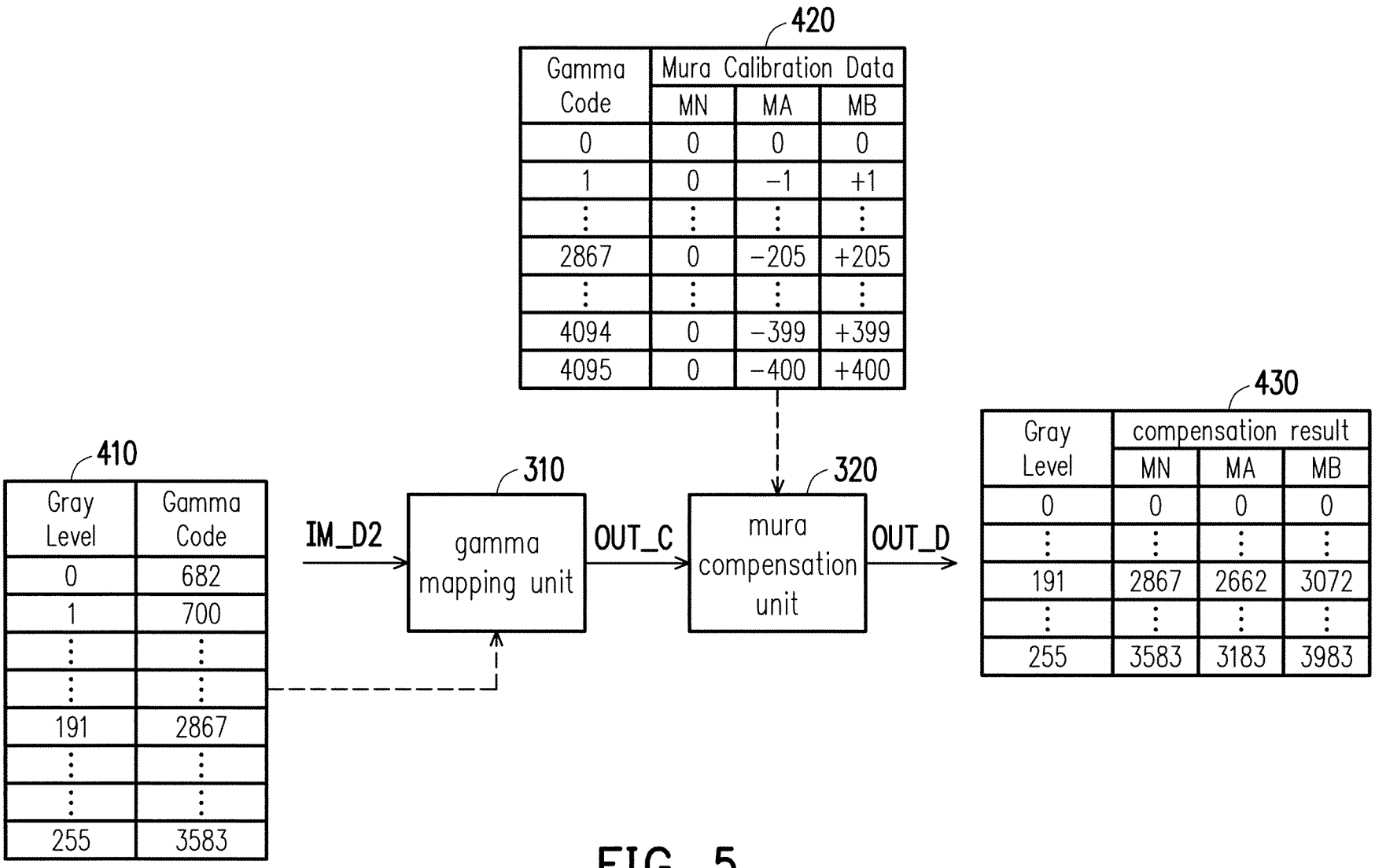
FIG. 5 illustrates the gamma mapping unit and the mura compensation unit depicted in FIG. 4.

FIG. 4 illustrates a schematic diagram of an integrated circuit for driving a display panel according to another exemplary embodiment. FIG. 5 illustrates a gamma mapping unit and a mura compensation unit. FIG. 5 can be applied to (but not limited to) the gamma mapping unit and the mura compensation unit depicted in FIG. 4. Referring to FIG. 4 and FIG. 5, the integrated circuit 300 of the present embodiment includes an image processing unit 330, a gamma mapping unit 310, a mura compensation unit 320, and a voltage generating unit 340. The voltage generating unit 340 includes a digital-to-analog converter unit 342 and an operating amplifier unit 344.

In the present embodiment, the image processing unit 330 receive an image data IM_D1 and performs image processing operations, such as image enhancement, sub-pixel rendering, etc., on the image data IM_D1 to generate image data IM_D2. The image processing unit 330 outputs the image data IM_D2 to the gamma mapping unit 310. The gamma mapping unit 310 receives a gray level of the image data IM_D2. The gamma mapping unit 310 maps the gray level to a gamma code OUT_C according to at least one gamma table 410, and outputs the gamma code OUT_C to the mura compensation unit 320.

Figure 6A:
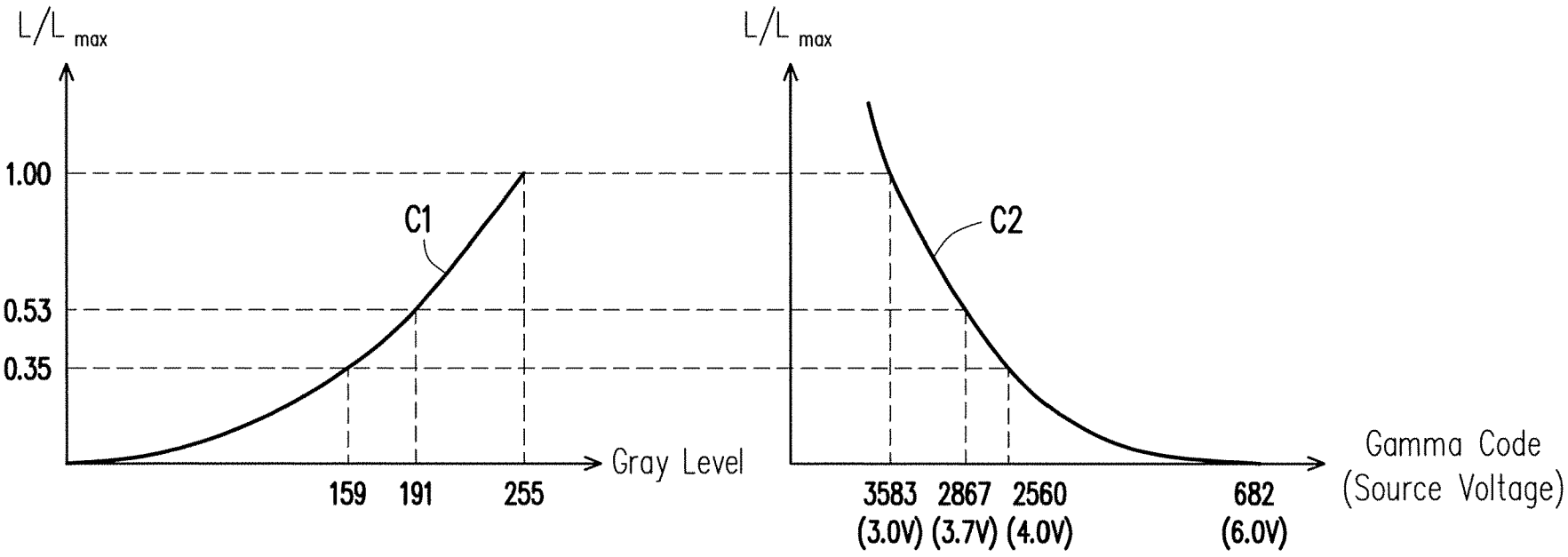
FIG. 6A and FIG. 6B illustrate a schematic diagram of a gamma mapping operation of the gamma mapping unit depicted in FIG. 4.
Figure 6B:
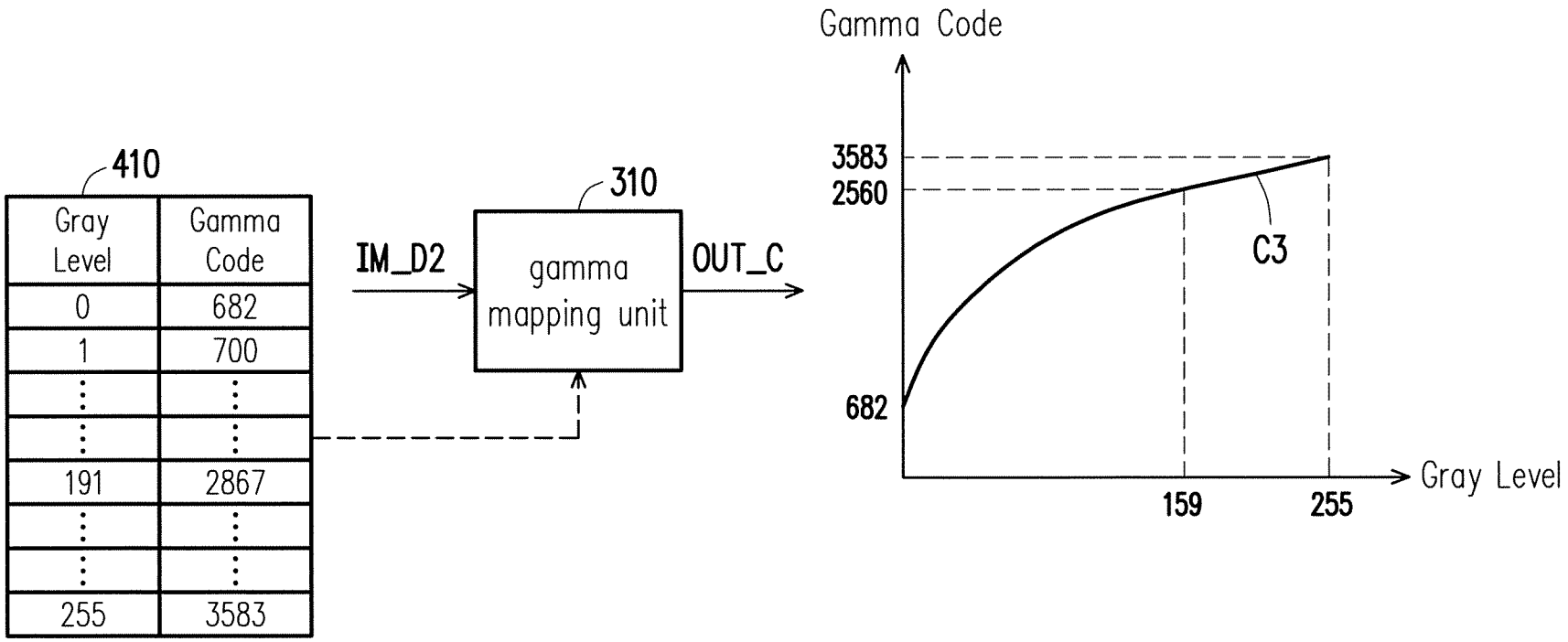

FIG. 6A and FIG. 6B illustrate a schematic diagram of a gamma mapping operation according to an embodiment. The gamma mapping operation can be applied to (but not limited to) the gamma mapping unit depicted in FIG. 4. Referring to FIG. 6A and FIG. 6B, the gamma table 410 of the present embodiment can be stored in the integrated circuit 300 or can be realized in other forms implementing the relationship recorded in the gamma table 410. The gamma table 410 can record a plurality of values of gamma code respectively corresponding to a plurality of values of gray level. The left column of the gamma table 410 corresponds to a characteristic of luminance versus gray level, where the horizontal axis is gray level and the vertical axis is normalized brightness $L/L_{max}$ of the display panel. The curve C1 may change according to a characteristics of the display panel such as process, material, gamma parameter, brightness or color temperature. The right column of the gamma table 410 corresponds to a characteristic of luminance versus gamma code (source voltage), where the horizontal axis is gamma code (source voltage) and the vertical axis is normalized brightness $L/L_{max}$ of the display panel. The curve C2 can be obtained by measuring brightness of a normal area MN of the display panel 200, for example, and related to the characteristics of the display panel such as process, material, gamma parameter, brightness or color temperature. The gamma mapping unit 310 maps the gray level of the image data IM_D2 to the gamma code OUT_C according to the gamma table 410 or based on a corresponding relationship realized in other forms, and outputs the gamma code OUT_C. The output of the gamma mapping unit 310 corresponds to a characteristic of gamma code versus gray level, where the horizontal axis is gray level and the vertical axis is gamma code. The curve C3 may change according to the characteristics of the display panel such as process, material, gamma parameter, brightness or color temperature.

Figure 7:
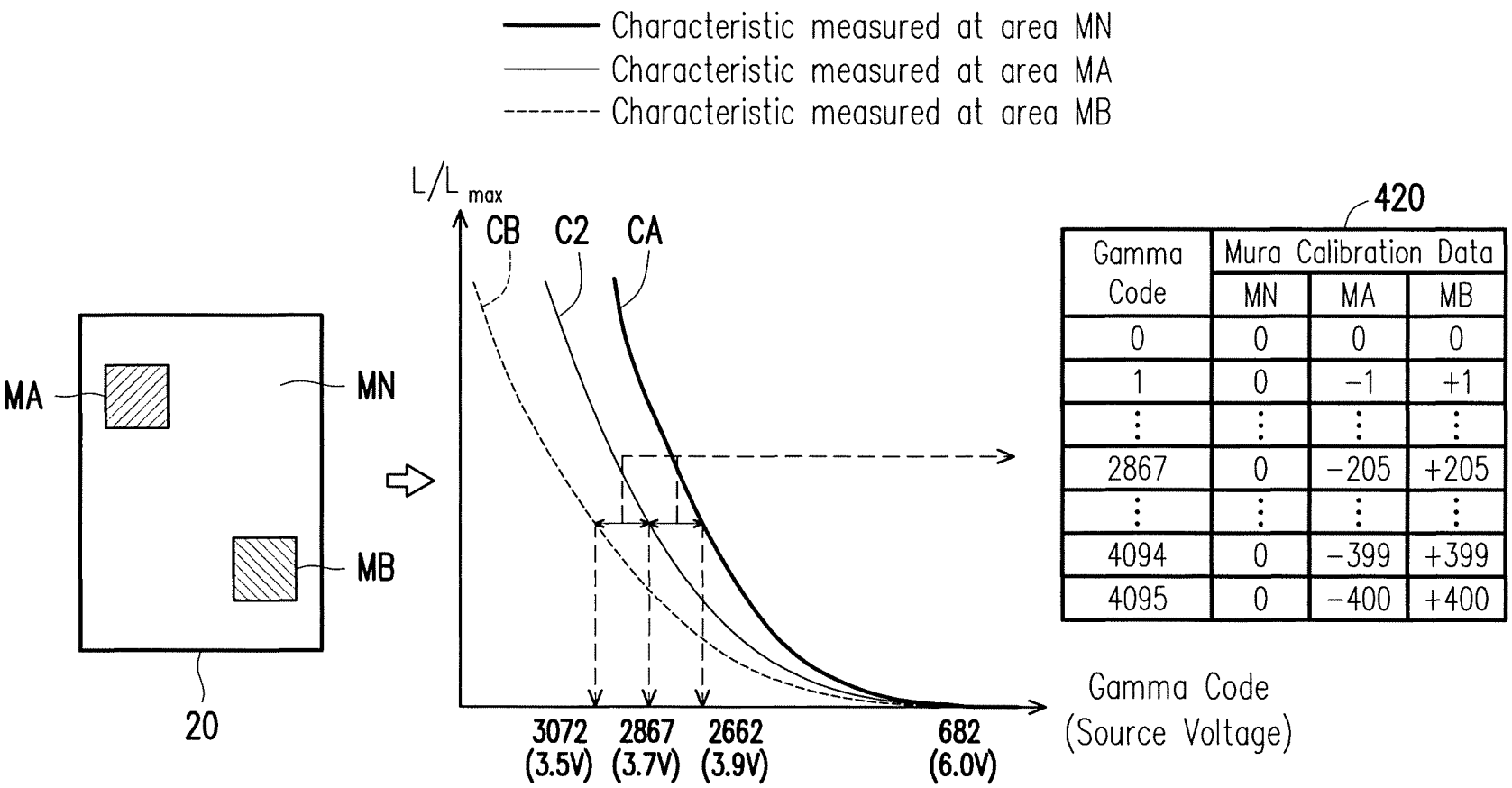
FIG. 7 illustrates a schematic diagram of a mura compensation operation of the mura compensation unit depicted in FIG. 4 and FIG. 5.

Referring to FIG. 4 and FIG. 5, the mura compensation unit 320 receives the gamma code OUT_C in the present embodiment. The mura compensation unit 320 compensates the gamma code OUT_C according to at least one de-mura table 420 to generate a compensation result OUT_D after the gamma mapping unit 310 performs the step of mapping the gray level to the gamma code. FIG. 7 illustrates a schematic diagram of a mura compensation operation of the mura compensation unit depicted in FIG. 4 and FIG. 5. Referring to FIG. 7, brightness/luminance of a plurality of panel areas MN, MA and MB of the display panel 20 before mura compensation is measured, where the panel area MN is a normal area without mura phenomenon, and the panel areas MA and MB are mura areas with mura defects. It is noted each of the panel areas MN, MA and MB can include one or more pixels or sub-pixels. A characteristic of luminance versus gamma code (source voltage) is obtained by measuring the panel areas MN, MA and MB before mura compensation, where the horizontal axis is gamma code (source voltage) and the vertical axis is normalized brightness $L/L_{max}$ of the display panel 20. The curve C2 is obtained by measuring brightness of the normal area MN of the display panel 20. The calibration curves CA and CB can be respectively obtained by measuring brightness of the mura areas MA and MB of the display panel 20.

In the present embodiment, the de-mura table 420 records mura calibration data for a plurality of panel areas, e.g. the panel areas MN, Mass. and MB. The mura calibration data is generated according to curve difference as shown in FIG. 7. The mura calibration data includes a plurality of values of mura calibration data respectively corresponding to a plurality values of gamma code for each of the panel areas. For example, the MA column includes the values of mura calibration data corresponding to the values of gamma code for the mura area MA, and other columns of the de-mura table 420 may be deduced by analogy. The mura calibration data represents a plurality of calibration curves respectively corresponding to the plurality of panel areas. In the present embodiment, the mura calibration data of the MA column represents the calibration curve CA corresponding to the panel area MA, and the mura calibration data of the MB column represents the calibration curve CB corresponding to the panel area MB.

Referring FIG. 4 and FIG. 5, after mura compensation, the mura compensation unit 320 outputs the compensation result OUT_D to the voltage generating unit 340. In the present embodiment, the compensation result OUT_D includes at least one compensated gamma table 430, where the compensated gamma table 430 includes compensated values of gamma codes. The voltage generating unit 340 receives the compensation result $OUT_D$, and generate a display voltage OUT_V according to the compensated gamma table 430 to drive a display panel, e.g. the display panel 200 depicted in FIG. 1. In the present embodiment, the digital-to-analog converter unit 342 receives the compensation result OUT_D, and converts the compensation result OUT_D of digital format to the compensation result OUT_A of analog format according to the compensated gamma table 430. The operating amplifier unit 344 receives the compensation result OUT_A and generates the display voltage OUT_V to drive the display panel.

As shown in FIG. 4 to FIG. 7, the mura compensation operation is performed on gamma codes after the gamma mapping operation. The gamma codes for different display areas are compensated according to the mura calibration data. The compensation result is outputted to the voltage generating unit to be converted into analog voltage for driving the display panel. In FIG. 7, after the display panel is manufactured, the characteristic of luminance versus gamma code (source voltage) may be obtained by measuring sub-pixel brightness of the display panel with respect to gamma code (source voltage). While mura phenomenon occurs, different calibration curves such as the curves CA and CB depicted in FIG. 7 may be obtained. Accordingly, the mura calibration data of the de-mura table including the values of mura calibration data respectively corresponding to the values of gamma code for each of the panel areas is generated according to curve difference. The de-mura table may be stored in the integrated circuit 300 for the mura compensation. After the mura compensation is performed on the gamma code, the corresponding source voltage has been compensated for different mura areas, and thus the display panel driven by the integrated circuit according to the source voltage may provide good display quality. The mura effect of the display panel is reduced.

In addition, since the de-mura table for each of the panel areas is generated according to the curve difference, the de-mura table does not change while the gamma table changes. The de-mura table is the same when a setting of the gamma table is modified based on one or more characteristics of the display panel such as process, material, gamma parameter, brightness or color temperature. Size of memory for storing the de-mura table can be reduced in the integrated circuit.

In the present embodiment, the block units of the integrated circuit 300 may be implemented by using adaptive circuit structures in the related art, which are not particularly limited in the invention. In addition, the foregoing values of calibration data, gamma codes and gray levels are exemplary for description and not intended to limit the invention.

Figure 8:
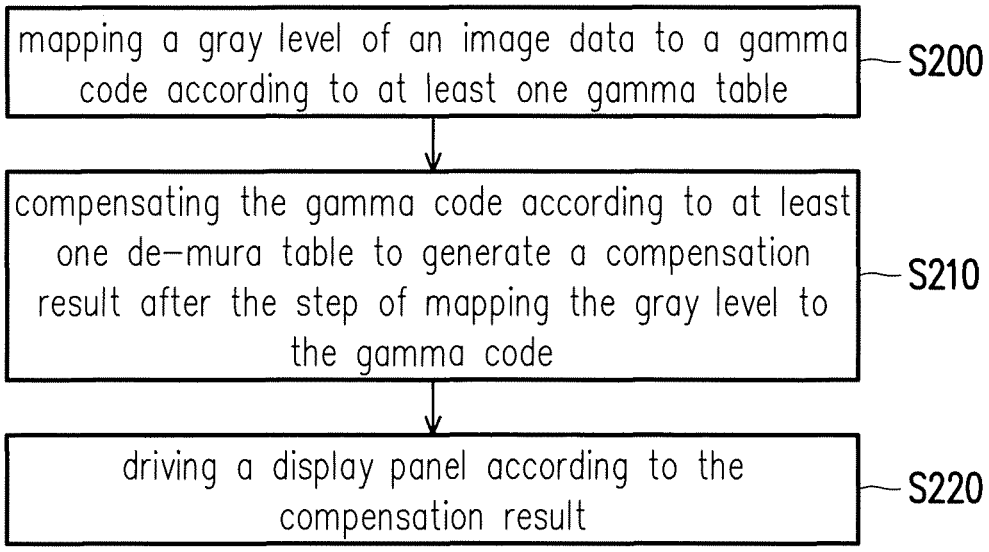
FIG. 8 is a flowchart illustrating steps in a method for driving a display panel according to another exemplary embodiment.

FIG. 8 is a flowchart illustrating steps in a method for driving a display panel according to another exemplary embodiment. The method can be applied to (but not limited to) any or a combination of the other embodiments of the disclosure. Referring to FIG. 5 and FIG. 8, the method of the present embodiment is at least adapted to the integrated circuit 300 of FIG. 5, but the invention is not limited thereto. Taking the integrated circuit 300 for example, in step S200, the gamma mapping unit 310 maps a gray level of an image data IM_D2 to a gamma code OUT_C according to at least one gamma table 410. In step S210, the mura compensation unit 320 compensates the gamma code OUT_C according to at least one de-mura table 420 to generate a compensation result OUT_D after the step of mapping the gray level to the gamma code OUT_C. In step S220, the integrated circuit 300 drives the display panel 200 according to the compensation result OUT_D. The mura effect of the display panel 200 is reduced.

Besides, the method for driving the display panel described in this embodiment of the disclosure is sufficiently taught, suggested, and embodied in the embodiments illustrated in FIG. 1 to FIG. 7, and therefore no further description is provided herein.

In summary, in the exemplary embodiments of the disclosure, the setting of the gamma table can be modified based on the characteristics of the display panel. The mura compensation operation can be performed after the gamma mapping operation. The mura effect of the display panel can be reduced. The de-mura table including the mura calibration data can therefore be the same even when the setting of the gamma table is modified. Moreover, the mura calibration data can be generated according to curve differences, wherein the curves can be gamma curves measured in different areas on a display panel. Accordingly, the memory size for storing the de-mura table can be reduced in the integrated circuit.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An integrated circuit for driving a display panel comprising:

a gamma mapping unit configured to receive a gray level of an image data, map the gray level to a gamma code according to at least one gamma table, and output the gamma code, wherein the at least one gamma table records a plurality of values of the gamma code respectively corresponding to a plurality of values of the gray level; and a mura compensation unit configured to receive the gamma code, and compensate the gamma code according to at least one de-mura table to generate a compensation result after the gamma mapping unit performs the step of mapping the gray level to the gamma code, wherein the compensation result represents corrected gamma code, wherein the corrected gamma code is generated by correcting the gamma code according to a mura calibration data of the at least one de-mura table, wherein the mura calibration data comprises a plurality of values of the mura calibration data respectively corresponding to the plurality of values of the gamma code for each of a plurality of panel areas, wherein the at least one de-mura table comprises values of the gamma code for each of the plurality of panel areas generated based on differences between calibration curves respectively obtained by measuring display parameters of the panel areas, and the at least one de-mura table is the same when a setting of the at least one gamma table is modified based on one or more characteristics of the display panel, wherein the integrated circuit drives the display panel according to the compensation result.

2. The integrated circuit according to claim 1, wherein the at least one de-mura table records the mura calibration data for the plurality of panel areas.

3. The integrated circuit according to claim 1, further comprising:

a voltage generating unit configured to receive the compensation result comprising a compensated value of gamma code, and generate a display voltage according to the compensated value of gamma code to drive the display panel.

4. An integrated circuit for driving a display panel comprising:

a transformation unit configured to perform a non-linear transformation on an image data to generate an output code based on a characteristics of the display panel; and a mura compensation unit configured to receive the output code from the transformation unit, and compensate the output code to reduce a mura effect of the display panel and generate a compensation result after the transformation unit performs the non-linear transformation, wherein the compensation result represents corrected gamma code, wherein the corrected gamma code is generated by correcting the gamma code according to a mura calibration data of the at least one de-mura table, wherein the mura calibration data comprises a plurality of values of the mura calibration data respectively corresponding to a plurality of values of the gamma code for each of a plurality of panel areas, wherein the at least one de-mura table comprises values of the gamma code for each of the plurality of panel areas generated based on differences between calibration curves respectively obtained by measuring display parameters of the panel areas, and the at least one de-mura table is the same when a setting of the at least one gamma table is modified based on one or more characteristics of the display panel, wherein the integrated circuit drives the display panel according to the compensation result.

5. The integrated circuit according to claim 4, wherein the non-linear transformation of the transformation unit comprises a gamma mapping.

6. A method for driving a display panel comprising:

mapping a gray level of an image data to a gamma code according to at least one gamma table, wherein the at least one gamma table records a plurality of values of the gamma code respectively corresponding to a plurality of values of the gray level;

compensating the gamma code according to at least one de-mura table to generate a compensation result after the step of mapping the gray level to the gamma code, wherein the compensation result represents corrected gamma code, wherein the corrected gamma code is generated by correcting the gamma code according to a mura calibration data of the at least one de-mura table, wherein the mura calibration data comprises a plurality of values of the mura calibration data respectively corresponding to the plurality of values of the gamma code for each of a plurality of panel areas, wherein the at least one de-mura table comprises values of the gamma code for each of the plurality of panel areas generated based on differences between calibration curves respectively obtained by measuring display parameters of the panel areas, and the at least one de-mura table is the same when a setting of the at least one gamma table is modified based on one or more characteristics of the display panel; and driving the display panel according to the compensation result.

7. The method according to claim 6, wherein the at least one de-mura table records the mura calibration data for the plurality of panel areas.

8. The method according to claim 6, wherein the compensation result comprises a compensated value of gamma code, and the method further comprises:

generating a display voltage according to the compensated value of gamma code to drive the display panel.

9. A method for driving a display panel comprising:

performing a non-linear transformation on an image data to generate an output code based on a characteristics of the display panel;

compensating the output code to reduce a mura effect of the display panel and generating a compensation result after the non-linear transformation, wherein the compensation result represents corrected gamma code, wherein the corrected gamma code is generated by correcting the gamma code according to a mura calibration data of the at least one de-mura table, wherein the mura calibration data comprises a plurality of values of the mura calibration data respectively corresponding to a plurality of values of the gamma code for each of a plurality of panel areas, wherein the at least one de-mura table comprises values of the gamma code for each of the plurality of panel areas generated based on differences between calibration curves respectively obtained by measuring display parameters of the panel areas, and the at least one de-mura table is the same when a setting of the at least one gamma table is modified based on one or more characteristics of the display panel; and driving the display panel according to the compensation result.

10. The method according to claim 9, wherein the non-linear transformation comprises a gamma mapping.

11. The method according to claim 10, wherein compensation data used in the compensating is the same when a setting of the non-linear transformation is modified.

* * * * *